US005199953A

United States Patent [19]

Fung et al.

[11] Patent Number: 5,199,953

[45] Date of Patent: Apr. 6, 1993

[54] PROCESS FOR REDUCING DISCOLORATION OF CELLULOSIC FIBERS, TREATED AT A HIGH TEMPERATURE WITH A SOLUTION OF A POLYCARBOXYLIC ACID AND BORIC ACID OR BORATE

[75] Inventors: Kwok-Wing Fung; Kam H. Wong; David L. Brotherton, all of Easley, S.C.

[73] Assignee: Ortec, Inc., Easley, S.C.

[21] Appl. No.: 819,453

[22] Filed: Jan. 10, 1992

Related U.S. Application Data

[63] Continuation of Ser. No. 582,342, Sep. 14, 1990, abandoned.

[51] Int. Cl.[5] ..... D06M 11/00; D06M 13/00; D06M 13/24

[52] U.S. Cl. ..... 8/120; 8/115.68; 8/116.1; 8/127.1

[58] Field of Search ..... 8/120, 127.1, 115.68

[56] References Cited

U.S. PATENT DOCUMENTS 5,137,537 8/1992 Herron et al. ..... 8/120
5,145,485 9/1992 Michna et al. ..... 8/527

FOREIGN PATENT DOCUMENTS 440472 8/1991 European Pat. Off. .

*Primary Examiner*—A. Lionel Clingman
*Attorney, Agent, or Firm*—Cort Flint

[57] ABSTRACT

A process for reducing discoloration of fibrous cellulosic material, treated at temperatures above about 175° C. with a treating solution of a polycarboxylic acid and a phosphate salt curing catalyst, comprises adding to the treating solution an inorganic boron-oxygen compound.

27 Claims, No Drawings

PROCESS FOR REDUCING DISCOLORATION OF CELLULOSIC FIBERS, TREATED AT A HIGH TEMPERATURE WITH A SOLUTION OF A POLYCARBOXYLIC ACID AND BORIC ACID OR BORATE

This is a continuation of application Ser. No. 07/582,342, filed on Sep. 14, 1990, now abandoned.

TECHNICAL FIELD

This invention relates to an improved process for imparting wrinkle resistance or durable press properties to cellulosic fabrics, wherein addition of an inorganic boron-oxygen compound to a polycarboxylic acid treating solution, reduces discoloration of fibrous cellulosic materials, treated with the polycarboxylic acid solutions at temperatures above about 175° C.

BACKGROUND ART

Numerous processes have been proposed for imparting wrinkle resistance, shrinkage resistance and smooth-drying properties to fabrics and garments, made from cotton or other cellulosic fibers. The treated garments or fabrics retain their dimensions, smooth appearance and normal shape while being worn and after numerous cycles of domestic washing with an alkaline detergent in a washing machine and drying in a tumble dryer.

In many processes, a solution of formaldehyde or a formaldehyde adduct and an acidic catalyst is applied to the textile and the treated fabric or textile is heated to bring about crosslinking of the cellulose molecules of the textile. Owing to the toxicity associated with formaldehyde and its adducts, alternative methods of imparting durable press characteristics to cellulosics are of considerable interest.

Welch et al., in U.S. Pat. No. 4,820,307, herein incorporated by reference, have proposed a process for formaldehyde-free durable press finishing of cotton textiles, in which the textile is treated with a solution of a polycarboxylic acid at elevated temperatures. Catalysts for the process include alkali metal dihydrogen phosphates and alkali metal salts of phosphorous, hypophosphorous and polyphosphoric acids. Cotton fabrics, thus treated with citric acid as the polycarboxylic acid, using sodium dihydrogen phosphate catalyst, discolor significantly upon treatment at 180° C. for 90 sec. The discoloration can be removed by post-treatment with various materials, of which the most effective are magnesium monoperoxyphthalate, sodium perborate, sodium borohydride, hydrochloric acid and sodium hypochlorite. Sodium tetraborate and boric acid are relatively ineffective for improving the whiteness of the fabrics.

Andrews, "Non-Formaldehyde Durable Press Finishing of Cotton with Citric Acid," 1989 International Conference and Exhibition, American Association of Textile Chemists and Colorists, pages 176–183, has proposed using citric acid, as at least a partial substitute for more expensive 1,2,3,4-butanetetracarboxylic acid, in compositions for imparting durable press properties to cellulosic fabrics. Yellowing of fabrics, treated with citric acid, is recognized as a problem, particularly in the case of treating solutions containing sodium dihydrogen phosphate or sodium hypophosphite catalyst, cured at 190° C. or 200° C. Use of lower curing temperatures resulted in generally improved whiteness indices, but decreased durable press ratings.

Welch et al., "Ester Crosslinks: A Route to High Performance Nonformaldehyde Finishing of Cotton," *Textile Chemist and Colorist*, vol. 21 (1989), pages 13–17, disclose using various polycarboxylic acids for the cross-linking of cellulosics. Sodium hypophosphite was judged the most effective catalyst for producing good durable press properties, without undue yellowing, even in the case of citric acid.

It is an object of this invention to provide an improved method for decreasing the yellowing of cellulosic fabrics, treated at a high temperature with one or more polycarboxylic acids in the presence of a phosphorus-containing catalyst.

DISCLOSURE OF INVENTION

This invention relates to a process for reducing discloration or yellowing of fibrous cellulosic materials, treated at temperatures above about 175° C., with a treating solution of a polycarboxylic acid and a phosphate salt curing catalyst, comprising adding to the treating solution an inorganic boron-oxygen compound.

This invention is applicable to fibrous cellulosic materials, containing at least 30% by weight of cellulosic fibers. Included among cellulosic fibers are cotton, flax, jute, hemp, ramie and regenerated unsubstituted wood cellulose, such as rayon. The process can be used for treating cellulosic materials in the form of knit or woven or nonwoven fabrics, as well as for treating fibers, linters, roving, slivers and paper. The process is preferably used for treating fibrous cellulosic materials in the form of knit, woven or nonwoven fabrics. Preferably, the process is used for the treatment of textile materials, containing 50–100% of cotton fibers.

The invention is based on the discovery that addition of an inorganic boron-oxygen compound to a polycarboxylic acid treating solution for cellulosic materials markedly reduces the tendency of the material, treated at temperatures above about 175° C., to discolor or turn yellow.

The inorganic boron-oxygen compound is selected from alkali metal borates, including metaborates, tetraborates and pentaborates. Typical alkali metal borates include sodium metaborate, sodium tetraborate, potassium metaborate, potassium tetraborate, potassium pentaborate, lithium metaborate, lithium tetaborate and lithium pentaborate in the form of anhydrate, tetrahydrate, pentahydrate, octahydrate or decahydrate. Another boron-oxygen compound, which can be added to the treating solutions, is boric acid. Preferably, the inorganic boron-oxygen compound is boric acid or sodium tetraborate or a hydrate thereof. Most preferably, the inorganic boron-oxygen compound is boric acid or borax (sodium tetraborate decahydrate), or a mixture thereof.

The amount of inorganic boron-oxygen compound, added to the polycarboxylic acid treating solution, is from about 0.5% to about 10% by weight of the solution. It has been found that addition of 1–5% by weight of borax or boric acid to the treating solutions markedly reduces yellowing resulting from high temperature treatment of cellulosic textiles, impregnated with the solutions. Preferably, the amount of inorganic boron-oxygen compound, added to the treating solution, is 1–5% by weight of the treating solution. Most preferably, 1–3% by weight of borax or boric acid is added to the treating solution.

Included within polycarboxylic acids in the treating solutions are aliphatic, alicyclic and aromatic acids, containing at least two carboxy groups. The aliphatic and alicylic acids can be saturated or unsaturated. Preferred members of the reactive group of compounds are saturated acids having at least three carboxylic acid groups or alpha,beta-unsaturated acids, having at least two carboxy groups. Most preferred polycarboxylic acids include, but are not limited to, maleic acid, citraconic acid (methylmaleic acid), citric acid (2-hydroxy-1,2,3-propanetricarboxylic acid), tricarballylic acid (1,2,3-propanetricarboxylic acid), trans-aconitic acid (trans-1-propene-1,2,3-tricarboxylic acid), 1,2,3,4-butanetetracarboxylic acid, allcis- 1,2,3,4-cyclopentanetetracarboxylic acid, mellitic acid (benzenehexacarboxylic acid) and oxydisuccinic acid (2,2'-oxybis(-butanedioic acid)), or mixtures thereof. The concentration of polycarboxylic acid in the treating solutions can be from about 0.5% by weight to about 20% by weight of the solution.

In the case of 1,2,3,4-butanetetracarboxylic acid (BTCA), it has been found that excellent durable press properties are obtained when the treating solution contains 3-7% by weight of BTCA.

The method of this invention is particularly preferred for use with treating solutions containing mixtures of 1,2,3,4-butanetetracarboxylic acid and citric acid (CA), the latter being considerably cheaper than the former. Preferred mixtures are those containing 10:1 to 1:3 parts by weight of BTCA:CA. When a mixture of acids is used in the treating solutions, the amount of acids is 3-7% by weight of the treating solution.

Addition of oxalic acid to replace some of the BTCA in the treating solutions is also contemplated. Textiles, impregnated with solutions containing a mixture of BTCA and oxalic acid, can be cured at temperatures as high as 250° C. The treated textiles have acceptable durable press and whiteness ratings.

Phosphate salt curing catalysts include, but are not limited to, alkali metal hypophosphites, alkali metal phosphites, alkali metal salts of polyphosphoric acids and alkali metal salts of orthophosphoric acid, including, as appropriate, hydrates thereof. The amount of phosphate salt curing catalyst in the treating solutions is from about 0.25% by weight to about 10% by weight of the treating solution.

Alkali metal hypophosphites can be represented by the formula $MH_2PO_2$, wherein M is an alkali metal cation. Sodium hypophosphite is preferred as a catalyst in the treating solutions. An observation in connection with the method of this invention is that addition of the inorganic boron-oxygen compound to treating solutions, containing a mixture of 1,2,3,4-butanetetracarboxylic acid and citric acids, not only markedly reduced discoloration of treated cellulosic textiles, but also reduced the amount of sodium hypophosphite catalyst required by permitting replacement of up to half of the hypophosphite with disodium hydrogen phosphate.

For example, treating solutions containing 3.2% by weight of sodium hypophosphite, 2% by weight of borax and a mixture of BTCA and CA, cured on cellulosic textiles at 200° C. or 210° C., give products with wrinkle recovery angles and tensile strength, similar to those of textiles treated under the same conditions with 6.4% of sodium hypophosphite, without borax, and the samples treated with borax-hypophosphite are considerably whiter. Therefore, use of borax in the treating compositions both improves whiteness of the treated textiles and reduces the required amount of an expensive catalyst in the treating solution.

Alkali metal phosphites can be represented by the formulas $M_2HPO_3$ and $MH_2PO_3$, wherein M is an alkali metal cation. Preferably, M is sodium. These phosphite salt curing catalysts are used in the same concentration as the hypophosphites.

Alkali metal salts of polyphosphoric acids include sodium, potassium and lithium salts of linear and cyclic condensed phosphoric acids. The cyclic oligomers of particular interest are trimetaphosphoric acid and tetrametaphosphoric acid. Linear condensed phosphoric acids include pyrophosphate, tripolyhosphates, and hexametaphosphates. Sodium salts are preferred. The amount of alkali metal polyphospates used in the treating solutions is as above.

Alkali metal salts of orthophosphoric acid include monobasic, dibasic and tribasic salts, represented by the formulas $MH_2PO_4$, $M_2HPO_4$ and $M_3PO_4$, respectively, wherein M is an alkali metal cation. Preferred members of this group are monosodium dihydrogen phosphate and disodium hydrogen phosphate. Disodium hydrogen phosphate is particularly preferred. It has been found that inclusion of the inorganic boron-oxygen compound in the treating solutions reduces the amount of orthophosphate salt required. The orthophosphate salts, particularly disodium hydrogen phosphate, can also be used in combination with an alkali metal hypophosphite, to reduce the amount of hypophosphite required.

Preferred phosphate salt curing catalysts are selected from among alkali metal hypophosphites, phosphites, pyrophosphates, tripolyphosphates or hexametaphosphates; alkali metal monohydrogen or dihydrogen phosphates, or a mixture thereof.

Addition of either borax or boric acid to treating solutions, containing 1,2,3,4-butanetetracarboxylic acid as crosslinking agent and disodium hydrogen phosphate as sole phosphate salt catalyst permits curing at 190°-200° C., without loss of whiteness, as determined by the CIE whiteness index.

A further advantage of this invention is that durable press properties can be imparted to dyed cellulosic textiles, without significant damage to the shade of the dyed textile. In addition, utilization of the process of this invention produces textiles with good durable press and whiteness properties in one step, rather than requiring post-treatment to bleach the treated textile material. The process is accordingly useful for imparting durable press properties to white or dyed, knit, woven or nonwoven fabrics or textiles.

The method of this invention is preferably used at temperatures above 180° C., up to as high as 250° C. The duration of the high temperature treatment can be determined by routine experimentation and is selected so as to give maximum throughput in a commercial textile finishing operation.

Preferred embodiments of this invention include:

(a) a process wherein the cellulosic material is treated at 180°-250° C., the polycarboxylic acid is 1,2,3,4-butanetetracarboxylic acid, the phosphate salt curing catalyst is disodium hydrogen phosphate and the inorganic boron-oxygen compound is sodium tetraborate or a hydrate thereof;

(b) a process wherein the cellulosic material is treated at 180°-250° C., the polycarboxylic acid is a mixture of 1,2,3,4-butanetetracarboxylic acid and citric acid, the phosphate salt curing catalyst is disodium hydrogen phosphate and the inorganic boron-oxygen compound is sodium tetraborate or a hydrate thereof;

(c) a process wherein the cellulosic material is treated at 180°-250° C., the polycarboxylic acid is 1,2,3,4-butanetetracarboxylic acid, the phosphate salt curing catalyst is a mixture of sodium hypophosphite and disodium hydrogen phosphate or a hydrate thereof and the inorganic boron-oxygen compound is sodium tetraborate or a hydrate thereof;

(d) a process wherein the cellulosic material is treated at 180°-250° C., the polycarboxylic acid is a mixture of 1,2,3,4-butanetetracarboxylic acid and citric acid, the phosphate salt curing catalyst is a mixture of disodium hydrogen phosphate and sodium hypophosphite or hydrates thereof and the inorganic boron-oxygen compound is sodium tetraborate or a hydrate thereof;

(e) a process wherein the cellulosic material is treated at 180°-250° C., the polycarboxylic acid is 1,2,3,4-butanetetracarboxylic acid, the phosphate salt curing catalyst is disodium hydrogen phosphate and the inorganic boron-oxygen compound is boric acid;

(f) a process wherein the cellulosic material is treated at a 180°-250° C., the polycarboxylic acid is a mixture of 1,2,3,4-butanetetracarboxylic acid and citric acid, the phosphate salt curing catalyst is disodium hydrogen phosphate and the inorganic boron-oxygen compound is boric acid;

(g) a process wherein the cellulosic material is treated at 180°-250° C., the polycarboxylic acid is a mixture of 1,2,3,4-butanetetracarboxylic acid and citric acid, the phosphate salt curing catalyst is a mixture of sodium hypophosphite and disodium hydrogen phosphate or hydrates thereof and the inorganic boron-oxygen compound is boric acid; and (h) a process wherein the cellulosic material is treated at 180°-250° C., the polycarboxylic acid is a mixture of 1,2,3,4-butanetetracarboxylic acid and citric acid, the phosphate salt curing catalyst is sodium hypophosphite or a hydrate thereof and the inorganic boron-oxygen compound is boric acid.

BEST MODE FOR CARRYING OUT THE INVENTION

In a most preferred embodiment, the cellulosic material is treated at 180°-250° C., the polycarboxylic acid is a mixture of 1,2,3,4-butanetetracarboxylic acid and citric acid, the phosphate salt curing catalyst is a mixture of sodium hypophosphite and disodium hydrogen phosphate and the inorganic boron-oxygen compound is borax.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

In the following examples, temperatures are set forth uncorrected in degrees Celsius. Unless otherwise indicated, all parts and percentages are by weight.

Test specimens were 100% 78×78 cotton fabric print cloth, weighing 3.2 oz/yd$^2$, obtained from TEST FABRICS, Inc., P.O. Box 420, Middlesex, N. J. 08846. The fabric was desized, scoured and bleached before testing. Unless otherwise indicated, reagents are reagent grade.

Conditioned wrinkle recovery angle was measured by the method of ATCC-66-1984. Tensile strength was measured according to ASTM-D-1682-64. Whiteness index (CIE) was measured using a MacBeth Color-Eye Spectrophotometer.

EXAMPLE 1

Effect of Boron Compounds on the Color and Wrinkle Recovery of Cotton Treated with 1,2,3,4-Butanetetracarboxylic Acid in the Presence of Disodium Hydrogen Phosphate Curing Catalyst Aqueous solutions containing 6.4% by weight of reagent grade 1,2,3,4-butanetetracarboxylic acid, 2.0-4.2% by weight of disodium hydrogen phosphate catalyst, 1.0% by weight of emulsified nonionic polyethylene fabric softener, 0.1% by weight of nonylphenol deca(ethylene oxide) wetting agent and a boron-containing decolorizing agent, were prepared. The compositions were used in the fabric treating bath.

Samples of desized cotton fabric were immersed in the treating solution and pad dried by being passed through the squeeze rolls of a wringer to give a wet pick-up of 90-110% by weight of treating solution on the fabric, based on the original dry weight of the fabric. The fabric was dried and cured in a forced-draft oven at the temperature specified for 4 min.

The treated fabric was evaluated for whiteness index (CIE) before laundering and for wrinkle recovery angle and tensile strength after one typical domestic laundering and drying cycle. The results are shown in Table 1.

As shown in Table 1, increasing the drying and curing temperature from 180° to 200° C. for control (no borax or boric acid) specimens increased the wrinkle recovery angle, but resulted in a decrease in the whiteness index and in tensile strength. Inclusion of borax gave a higher wrinkle recovery angle, with retention of a high whiteness index at the higher temperature cure. Similar results were observed when boric acid was added.

EXAMPLE 2

Effect of Boron Compounds on the Color and Wrinkle Recovery of Cotton Treated with Technical Grade 1,2,3,4-Butanetetracarboxylic Acid in the Presence of Disodium Hydrogen Phosphate Curing Catalyst Treating solutions were prepared as in Example 1, except that technical grade 1,2,3,4-butanetetracarboxylic acid was used. Results are shown in Table 2. Addition of borax or boric acid to the treating solutions improved the whiteness index of the treated specimens, even at drying and curing at 190° C. or 200° C.

TABLE 1

Effect of Boron Compounds on the Whiteness and Wrinkle Recovery Angle of Cotton Treated with Reagent Grade 1, 2, 3, 4-Butanetetracarboxylic Acid (Disodium Hydrogen Phosphate Catalyst)

| Boron Compound | % $Na_2HPO_4$ | Dry/Cure Temp. (°C.) | Wrinkle Recovery Angle | Tensile Strength (lbs) | Whiteness Index (CIE) |
|---|---|---|---|---|---|
| none | 4.2 | 180 | 264 | 24.7 | 68.0 |
| none | 4.2 | 190 | 268 | 26.0 | 67.4 |
| none | 4.2 | 200 | 270 | 23.6 | 66.6 |
| 2.0% $Na_2B_4O_7.10H_2O$ | 4.2 | 190 | 275 | 29.3 | 75.7 |

TABLE 1-continued

Effect of Boron Compounds on the Whiteness and Wrinkle Recovery Angle of Cotton Treated with Reagent Grade 1, 2, 3, 4-Butanetetracarboxylic Acid (Disodium Hydrogen Phosphate Catalyst)

| Boron Compound | % $Na_2HPO_4$ | Dry/Cure Temp. (°C.) | Wrinkle Recovery Angle | Tensile Strength (lbs) | Whiteness Index (CIE) |
|---|---|---|---|---|---|
| 3.0% $Na_2B_4O_7.10H_2O$ | 4.2 | 190 | 261 | 30.8 | 76.7 |
| 1.0% $H_3BO_3$ | 4.2 | 190 | 261 | 29.0 | 75.6 |
| 2.0% $Na_2B_4O_7.10H_2O$ | 4.2 | 200 | 268 | 24.2 | 74.3 |
| 3.0% $Na_2B_4O_7.10H_2O$ | 4.2 | 200 | 260 | 28.5 | 74.3 |
| 1.0% $H_3BO_3$ | 4.2 | 200 | 261 | 29.0 | 75.6 |
| untreated fabric | | | | 47.2 | 78.8 |

TABLE 2

Effect of Boron Compounds on the Whiteness and Wrinkle Recovery Angle of Cotton Treated with Technical Grade 1, 2, 3, 4-Butanetetracarboxylic Acid (Disodium Hydrogen Phosphate Catalyst)

| Boron Compound | % $Na_2HPO_4$ | Dry/Cure Temp. (°C.) | Wrinkle Recovery Angle | Tensile Strength (lbs) | Whiteness Index (CIE) |
|---|---|---|---|---|---|
| none | 3.0 | 180 | 261 | 28.2 | 60.8 |
| none | 4.0 | 190 | 269 | 29.7 | 58.9 |
| none | 4.2 | 200 | 267 | 23.3 | 55.3 |
| 3.0% $Na_2B_4O_7.10H_2O$ | 3.0 | 180 | 258 | 33.0 | 71.7 |
| 3.0% $H_3BO_3$ | 3.0 | 180 | 243 | 33.0 | 71.2 |
| 2.0% $H_3BO_3$ | 4.0 | 190 | 252 | 27.7 | 65.6 |
| 2.0% $Na_2B_4O_7.10H_2O$ | 4.2 | 200 | 270 | 24.5 | 64.8 |
| untreated fabric | | | | 47.2 | 78.8 |

EXAMPLE 3

Effect of Sodium Tetraborate on the Properties of Cotton Fabrics Crosslinked with a Mixture of 1,2,3,4-Butanetetracarboxylic Acid and Citric Acid in the Presence of Disodium Hydrogen Phosphate and Sodium Hypophosphite Curing Catalysts Aqueous solutions of 3.2–4.2% by weight of 1,2,3,4-butanetetracarboxylic acid (BTCA) mixed with 2.1–3.2% by weight of citric acid, 0–4.2% by weight of disodium hydrogen phosphate and 0–3.2% by weight of sodium hypophosphite monohydrate catalysts, 1.0% by weight of emulsified nonionic polyethylene fabric softener, 0.1% by weight of nonylphenol deca(ethylene oxide) wetting agent and 0–2.0% by weight of sodium tetraborate decahydrate decolorizing agent.

The treating solution was applied as in Example 1 and the specimens were dried and cured at 200° C. or 210° C. The whiteness index (CIE) was determined before laundering and tensile strength and wrinkle recovery angle were determined after one domestic washing and drying cycle. Results are presented in Table 3.

As shown in Table 3, specimens treated with baths containing no borax had low whiteness indexes, particularly when dried and cured at 210° C. Relatively good whiteness indexes were observed for specimens, treated with a mixture of BTCA and citric acid, notwithstanding the reputation of citric acid for causing yellowing of cotton fabrics. In addition, specimens treated with solutions containing both borax and citric acid had high wrinkle recovery angles and good tensile strength values.

Inclusion of borax in treating solutions, containing sodium hypophosphite and disodium hydrogen phosphate, resulted in good whiteness, high tensile strength and high wrinkle recovery angles, even at lower concentrations of sodium hypophosphite than generally required (6.4%) to produce acceptable results. Therefore, treating solutions containing disodium hydrogen phosphate and borax, require less sodium hypophophite than previously required for crosslinking cotton and give an undiscolored product.

TABLE 3

Effect of Sodium Tetraborate on the Properties of Cotton Fabric Treated with 1, 2, 3, 4-Butanetetracarboxylic and Citric Acids (Disodium Hydrogen Phosphate and Sodium Hypophosphite Catalysts)

| $Na_2B_4O_7$. $10H_2O$ (%) | Catalyst (%) $Na_2HPO_4$ | Catalyst (%) $NaH_2PO_2.H_2O$ | CA | BTCA (%) | Dry/Cure Temp. (°C.) | Wrinkle Recovery Angle (°) | Tensile Strength (lb) | Whiteness Index (CIE) |
|---|---|---|---|---|---|---|---|---|
| none | 4.2 | none | 2.1 | 4.5 | 200 | 289 | 23.3 | 64.3 |
| none | 4.2 | none | 2.1 | 4.5 | 210 | 288 | 24.0 | 50.0 |
| 2.0 | 4.2 | none | 2.1 | 4.5 | 200 | 264 | 26.0 | 73.9 |
| 2.0 | 4.2 | none | 2.1 | 4.5 | 210 | 280 | 24.0 | 68.4 |
| none | none | 6.4 | 2.1 | 4.5 | 200 | 294 | 20.5 | 47.8 |
| none | none | 6.4 | 2.1 | 4.5 | 210 | 300 | 20.3 | 39.0 |
| none | 2.1 | 3.2 | 2.1 | 4.5 | 200 | 307 | 25.3 | 63.8 |
| none | 2.1 | 3.2 | 2.1 | 4.5 | 210 | 302 | 22.8 | 54.0 |
| 2.0 | 2.1 | 3.2 | 2.1 | 4.5 | 200 | 284 | 25.8 | 74.8 |
| 2.0 | 2.1 | 3.2 | 2.1 | 4.5 | 210 | 294 | 24.0 | 73.2 |
| 2.0 | none | 3.2 | 2.1 | 4.5 | 200 | 268 | 22.8 | 62.2 |
| 2.0 | none | 3.2 | 2.1 | 4.5 | 210 | 276 | 21.7 | 58.8 |
| none | 4.2 | none | 3.2 | 3.2 | 200 | 252 | 20.1 | 45.4 |
| none | 4.2 | none | 3.2 | 3.2 | 210 | 263 | 22.6 | 19.1 |
| 2.0 | 4.2 | none | 3.2 | 3.2 | 200 | 246 | 20.0 | 68.0 |

TABLE 3-continued

Effect of Sodium Tetraborate on the Properties of Cotton Fabric Treated with 1, 2, 3, 4-Butanetetracarboxylic and Citric Acids (Disodium Hydrogen Phosphate and Sodium Hypophosphite Catalysts)

| $Na_2B_4O_7$. $10H_2O$ (%) | Catalyst (%) $Na_2HPO_4$ | $NaH_2PO_2.H_2O$ | CA | BTCA (%) | Dry/Cure Temp. (°C.) | Wrinkle Recovery Angle (°) | Tensile Strength (lb) | Whiteness Index (CIE) |
|---|---|---|---|---|---|---|---|---|
| 2.0 | 4.2 | none | 3.2 | 3.2 | 210 | 255 | 22.5 | 57.3 |
| none | 2.1 | 3.2 | 3.2 | 3.2 | 200 | 263 | 20.7 | 60.3 |
| none | 2.1 | 3.2 | 3.2 | 3.2 | 210 | 262 | 20.4 | 48.9 |
| 2.0 | 2.1 | 3.2 | 3.2 | 3.2 | 200 | 249 | 20.7 | 73.2 |
| 2.0 | 2.1 | 3.2 | 3.2 | 3.2 | 210 | 262 | 21.3 | 67.6 |

EXAMPLE 4

Effect of Sodium Tetraborate on the Properties of Cotton Crosslinked with 1,2,3,4-Butanetetracarboxylic Acid in the Presence of Disodium Hydrogen Phosphate and Oxalic Acid Catalysts Aqueous solutions, containing 6.4% by weight of BTCA crosslinking agent, 4.2% by weight of disodium hydrogen phosphate and 1.0–2.0% by weight of oxalic acid catalyst, 1.0% by weight of emulsified nonionic polyethylene fabric softener, 0.1% by weight of nonylphenol deca(ethylene oxide) and 2.0% by weight of sodium tetraborate decahydrate decolorizing agent, were prepared and applied to cotton specimens as in the foregoing examples. Results are presented in Table 4.

These results show that cellulosics, cured with BTCA and oxalic acid in a treating solution containing sodium tetraborate decahydrate, at a very high temperature (210° C.) have good wrinkle recovery angle and reasonable tensile strength and whiteness.

EXAMPLE 5

Effect of Sodium Tetraborate on the Shade of Dyed Fabrics, Treated with 1,2,3,4-Butanetetracarboxylic Acid and Citric Acid Crosslinking Agents in the Presence of Disodium Hydrogen Phosphate and Sodium Hypophosphite Catalysts Aqueous solutions, containing 4.5–6.4% by weight of 1,2,3,4-butanetetracarboxylic acid, 0–4.2% by weight of disodium hydrogen phosphate, 0–6.4% by weight of sodium hypophosphite monohydrate, 0–2.1% by weight of citric acid, 1.0% by weight emulsified nonionic polyethylene fabric softener, 0.1% by weight of nonylphenol deca(ethylene oxide) wetting agent and 0–3.0% by weight of sodium tetraborate decahydrate, were prepared. The solutions were used to impart wrinkle resistance to samples of 100% cotton fabric, dyed with representative sulfur dyes, vat dyes, fiber-reactive dyes or naphthol dyes. The dyed samples were immersed in the treating solution and pad dried by being passed through the squeeze rolls of a wringer to a wet pick-up of 90–110% by weight of treating solution on the fabric specimen. The fabric specimens were dried and cured in a forced draft oven at the temperature specified for 4 min. The color shades of treated and untreated fabrics are compared in the results of Table 5.

TABLE 4

Effect of Sodium Tetraborate on the Properties of Cotton Fabric Treated with 1, 2, 3, 4-Butanetetracarboxylic Acid (Disodium Hydrogen Phosphate or Oxalic Acid Catalysts)

| $Na_2B_4O_7$. $10H_2O$ (%) | Catalyst (%) $Na_2HPO_4$ | Oxalic Acid | Dry/Cure Temp. (°C.) | Wrinkle Recovery Angle (°) | Tensile Strength (lb) | Whiteness Index (CIE) |
|---|---|---|---|---|---|---|
| 2.0 | 4.2 | none | 200 | 268 | 24.2 | 74.3 |
| 2.0 | 4.2 | 2.0 | 200 | 258 | 24.3 | 70.1 |
| 2.0 | 4.2 | 1.0 | 200 | 254 | 27.3 | 67.4 |
| 2.0 | 4.2 | none | 215 | 265 | 24.3 | 61.7 |
| 2.0 | 4.2 | 2.0 | 215 | 281 | 20.7 | 57.4 |
| 2.0 | 4.2 | 1.0 | 215 | 268 | 25.0 | 66.6 |

TABLE 5

Effect of Sodium Tetraborate on the Shade of Dyed Fabrics, Crosslinked with 1, 2, 3, 4-Butanetetracarboxylic and Citric Acids (Disodium Hydrogen Phosphate and/or Sodium Hypophosphite Catalysts)

| | | | | | | |
|---|---|---|---|---|---|---|
| BTCA (%) | 6.4 | 6.4 | 4.5 | 4.5 | 4.5 | 4.5 |
| $Na_2B_4O_7.10H_2O$ (%) | none | 2.0 | none | 2.0 | 3.0 | 2.0 |
| $Na_2HPO_4$ (%) | none | 4.2 | 2.1 | 2.1 | 2.1 | 4.2 |
| $NaH_2PO_2.H_2O$ (%) | 6.4 | none | 3.2 | 3.2 | 3.2 | none |
| Citric acid (%) | none | none | 2.1 | 2.1 | 2.1 | 2.1 |
| Dry/cure temp. (°C.) | 193 | 193 | 193 | 193 | 193 | 193 |
| Sulfur dye (green) | OC* | NC | OC | SC | SC | NC |
| Vat dye (Blue No. 6) | OC | NC | OC | SC | SC | NC |
| Fiber reactive dye (violet) | OC | NC | OC | SC | NC | NC |

TABLE 5-continued

Effect of Sodium Tetraborate on the Shade of Dyed Fabrics, Crosslinked with 1, 2, 3, 4-Butanetetracarboxylic and Citric Acids (Disodium Hydrogen Phosphate and/or Sodium Hypophosphite Catalysts)

| | | | | | | |
|---|---|---|---|---|---|---|
| Naphthol dye (red) | OC | NC | SC | NC | NC | NC |

*OC = obvious change in color shade, compared to untreated dyed fabric
SC = slight change
NC = no visible change Specimens treated with BTCA and sodium hypophosphite exhibit marked changes in color shade. Addition of borax to the treating composition markedly reduced the changes in color shade, compared to an untreated control. Similar improvement in dye shade retention resulted from addition of borax to a treating solution, containing BTCA, citric acid, sodium hypophosphite and disodium hydrogen phosphate.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

We claim:

1. A process for reducing the formation of discoloration in fibrous cellulosic material treated at temperatures above about 175° C. with an aqueous durable-press treating solution of a polycarboxylic acid selected from aliphatic, alicyclic and aromatic acids, containing at least two carboxylic acid groups; a phosphate salt curing catalyst selected from alkali metal hypophosphites, alkali metal phosphites, alkali metal salts of polyphosphoric acids and alkali metal salts of orthophosphoric acid and hydrates thereof; comprising adding to the aqueous durable-press treating solution an inorganic boron-oxygen compound selected from alkali metal metaborates, alkali metal tetraborates, alkali metal pentaborates and boric acid and heating the fibrous cellulosic material in the resulting treating bath at a temperature above about 175° to block the formation of said discoloration while imparting durable-press properties to the thus-treated cellulosic fibrous material.

2. The process of claim 1 wherein the cellulosic material is treated at 180°-250° C.

3. The process of claim 1, wherein the polycarboxylic acid is maleic acid, citraconic acid, citric acid, itaconic acid, tricarballylic acid, transaconitic acid, 1, 2, 3, 4-butanetetracarboxylic acid, all-cis-1, 2, 3, 4-cyclopentanetetra-carboxylic acid, mellitic acid or oxydisuccinic acid or a mixture thereof.

4. The process of claim 1 wherein the phosphate salt curing catalyst is an alkali metal hypophosphite, phosphite, pyrophosphate, tripolyphosphate, hexametaphosphate, monohydrogen phosphate or dihydrogen phosphate or a mixture thereof.

5. The process of claim 1, wherein the inorganic boron-oxygen compound is boric acid.

6. The process of claim 1, wherein the inorganic boron-oxygen compound is sodium tetraborate or a hydrate thereof.

7. The process of claim 1, wherein the phosphate salt curing catalyst is disodium hydrogen phosphate.

8. The process of claim 1, wherein the phosphate salt curing catalyst is sodium hypophosphite or a hydrate thereof.

9. The process of claim 1, wherein the polycarboxylic acid is 1,2,3,4-butanetetracarboxylic acid.

10. The process of claim 1 wherein the polycarboxylic acid is a mixture of 1,2,3,4-butanetetracarboxylic acid and citric acid.

11. The process of claim 1 wherein the cellulosic material is treated at 180°-250° C., the polycarboxylic acid is 1,2,3,4-butanetetracarboxylic acid, the phosphate salt curing catalyst is disodium hydrogen phosphate and the inorganic boron-oxygen compound is sodium tetraborate or a hydrate thereof.

12. The process of claim 1 wherein the cellulosic material is treated at 180°-250° C., the polycarboxylic acid is a mixture of 1,2,3,4-butanetetracarboxylic acid and citric acid, the phosphate salt curing catalyst is disodium hydrogen phosphate and the inorganic boron-oxygen compound is sodium tetraborate or a hydrate thereof.

13. The process of claim 1 wherein the cellulosic material is treated at 180°-250° C.; the polycarboxylic acid is a mixture of 1,2,3,4-butanetetracarboxylic acid and citric acid, the phosphate salt curing catalyst is a mixture of sodium hypophosphite and disodium hydrogen phosphate or hydrates thereof and the inorganic boron-oxygen compound is sodium tetraborate or a hydrate thereof.

14. The process of claim 1 wherein the cellulosic material is treated at 180°-250° C., the polycarboxylic acid is a mixture of 1,2,3,4-butanetetracarboxylic acid and citric acid, the phosphate salt curing catalyst is sodium hypophosphite or a hydrate thereof and the inorganic boron-oxygen compound is sodium tetraborate or a hydrate thereof.

15. The process of claim 1 wherein the cellulosic material is treated at 180°-250° C., the polycarboxylic acid is 1,2,3,4-butanetetracarboxylic acid, the phosphate salt curing catalyst is disodium hydrogen phosphate and the inorganic boron-oxygen compound is boric acid.

16. The process of claim 1 wherein the cellulosic material is treated at 180°-250° C., the polycarboxylic acid is a mixture of 1,2,3,4-butanetetracarboxylic acid and citric acid, the phosphate salt curing catalyst is disodium hydrogen phosphate and the inorganic boron-oxygen compound is boric acid.

17. The process of claim 1 wherein the cellulosic material is treated at 180°-250° C., the polycarboxylic acid is a mixture of 1,2,3,4-butanetetracarboxylic acid and citric acid, the phosphate salt curing catalyst is a mixture of sodium hypophosphite and disodium hydrogen phosphate or hydrates thereof and the inorganic boron-oxygen compound is boric acid.

18. The process of claim 1 wherein the cellulosic material is treated at 180°-250° C., the polycarboxylic acid is a mixture of 1,2,3,4-butanetetracarboxylic acid and citric acid, the phosphate salt curing catalyst is sodium hypophosphite or a hydrate thereof and the inorganic boron-oxygen compound is boric acid.

19. The process of claim 1 wherein the phosphate salt curing catalyst is a mixture of disodium hydrogen phosphate and sodium hypophosphite or a hydrate thereof.

20. The process of claim 1 wherein the inorganic boron-oxygen compound is a mixture of boric acid and sodium tetraborate or a hydrate thereof.

21. The process of claim 1 wherein the cellulosic material contains at least 30% by weight of cellulosic fibers, selected from the group consisting of cotton, flax, jute, hemp, ramie and regenerated unsubstituted wood cellulose.

22. The process of claim 1 wherein the cellulosic material is in the form of knit, woven or nonwoven fabrics.

23. The process of claim 1 wherein the cellulosic material contains 50–100% of cotton fiber.

24. The process of claim 1 wherein the cellulosic material is white or dyed knit, woven or nonwoven fabric.

25. The process of claim 1 wherein the treating solution contains from about 0.5% to about 20% by weight of polycarboxylic acid.

26. The process of claim 1 wherein the treating solution contains from about 0.25% to about 10% by weight of the phosphate salt curing catalyst.

27. The process of claim 1 wherein the treating solution contains from about 0.5% to about 10% by weight of the inorganic boron-oxygen compound.

* * * * *